United States Patent [19]

Kallenbach

[11] Patent Number: 4,949,419

[45] Date of Patent: Aug. 21, 1990

[54] POOL CLEANER COMPONENT

[75] Inventor: Dieter H. F. Kallenbach, Chartwell, South Africa

[73] Assignee: BPH Patent Holding AG, Switzerland

[21] Appl. No.: 317,963

[22] Filed: Mar. 2, 1989

[51] Int. Cl.[5] ..... E04H 3/20

[52] U.S. Cl. ..... 15/246; 15/1.7

[58] Field of Search ..... 15/1.7, 246, 257 R, 15/257 A, 338, 375, 397, 415 R, 417–422

[56] References Cited

U.S. PATENT DOCUMENTS

| | | | |
|---|---|---|---|
| 2,243,935 | 6/1941 | Williamson | 15/338 X |
| 4,193,156 | 3/1980 | Chauvier | 15/1.7 |
| 4,351,077 | 9/1982 | Hofmann | 15/1.7 |
| 4,530,125 | 7/1985 | Hofmann | 15/1.7 |

*Primary Examiner*—Edward L. Roberts

*Attorney, Agent, or Firm*—Arnold, White & Durkee

[57] ABSTRACT

This invention is concerned with flexible plastics material discs which are shaped to engage around the inlets to automatically operating swimming pool cleaners which are caused to move by an interruption of the flow induced through the cleaner by the pump of the pool filtration plant. The discs act to hold the cleaner against the surface to be cleaned and the invention provides guides on the upper surface of the disc preferably in the form of radially extending ribs decreasing in height towards the periphery of the disc. The guides direct dirt over the disc into the inlet of the pool cleaner.

8 Claims, 2 Drawing Sheets

POOL CLEANER COMPONENT

BACKGROUND

This invention relates to a pool cleaner component and more particularly to the flexible surface engaging disc used on some cleaners to hold the cleaner onto the surface to be cleaned. Particularly the component is for use with pool cleaners which are caused to move automatically over the surface to be cleaned by interruption in water flow induced through the cleaner by the swimming pool filtration pump.

Some pool cleaners such as those sold under the registered trademarks of "BARACUDA" and "KREEPY KRAULY" utilize a flexible disc which contacts the surface to be cleaned and assists in holding the cleaner against that surface. The disc moves over the surface and much of the dirt to be collected moves over the top surface through apertures in the body located centrally of the disc and thence to the filter plant of the swimming pool. The cleaners above referred to have covers of one form or another which extend from the openings in the body over the disc to the periphery so that channels are formed to constrain and guide the dirt particles into the body.

The provision of these covers add to the expense of the pool cleaners and it has been surprisingly found that they do not add greatly to the efficacy of the dirt collection.

According to this invention there is provided a flexible disc for use with cleaners of the type referred to having guides on the upper surface thereof which extend from the central opening outwardly at least halfway to the periphery of the disc.

Further features of this invention provide for the guides to extend to the periphery of the disc and to be a pair of radial ribs spaced apart and increasing in height from the periphery to the central opening.

The invention also provides for there to be eight ribs equally spaced apart on the disc and for the disc to be split where a high degree of flexibility is required.

Still further features of the invention provide for the slits to extend radially inwardly from the periphery of the disc to the ends of the ribs where these extend partway across the disc, for the disc to increase in thickness from the periphery towards the central opening and for the ribs to be notched at least one position intermediate their ends.

Discs of the kind defined above are made of plastics material. Polyurethane has been found suitable for use in swimming pools having a cementitious wall surface finish but other materials can be used where the surface finish of the wall is provided by a plastics material lining such as polyvinyl chloride or fiberglass in resin.

PREFERRED EMBODIMENT

Preferred embodiments of this invention will be described with reference to the accompanying drawings in which.

Figure 1:
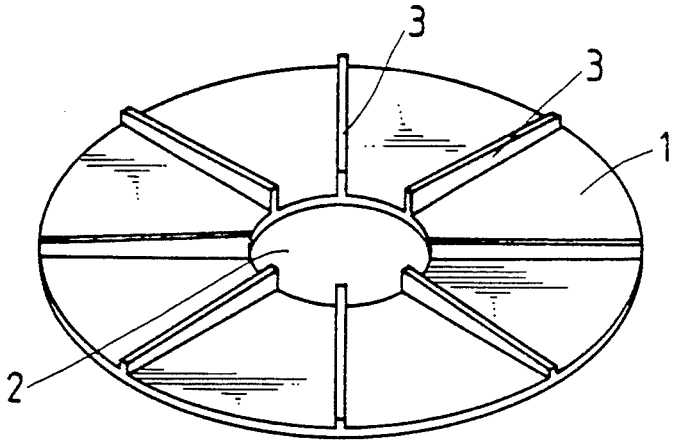
FIG. 1 shows a disc with ribs extending across the full width of the disc.

As shown in FIG. 1 the disc 1 is made of the usual size for pool cleaners of the type referred to which is about 42.5 mms in diameter and 2 to 3 mms thick. It has a central opening 2 which engages around the body of the cleaner between retaining flanges formed on the body. Apertures are made through the wall of the body between the flanges and the disc can rotate around the body. This enables the cleaner to move randomly more easily over the surface to be cleaned than is the case when the disc is held in position on the body.

In the case of one type of pool cleaner these openings in to the body extend around the greater part of the periphery of the body which faces the direction of movement when the cleaner is in use.

The disc above described is fitted in the usual way and it will be noted that at least two pairs of ribs 3 extend from the periphery of the disc to the openings into the body. Thus there is at all times, even when the disc moves around the body, guided paths to constrain dirt flow over the upper surface of the disc from the edge towards the central opening. In use it has been found that the ribs 3 tend to retain the dirt between them and facilitate the movement thereof into the body and thence to the filter plant for the swimming pool water.

This has been found to be so in spite of the pulsating flow of water through the cleaner in use. It appears that the guiding influence of the ribs alone is sufficient to facilitate movement of the collected dirt along the desired path.

The ribs decrease in height from the central opening to the edge and this makes the disc more flexible towards its periphery.

The invention thus obviates the necessity for the use of at least one component presently in use in some types of existing swimming pool cleaners while nevertheless providing satisfactory cleaning.

Figure 2:
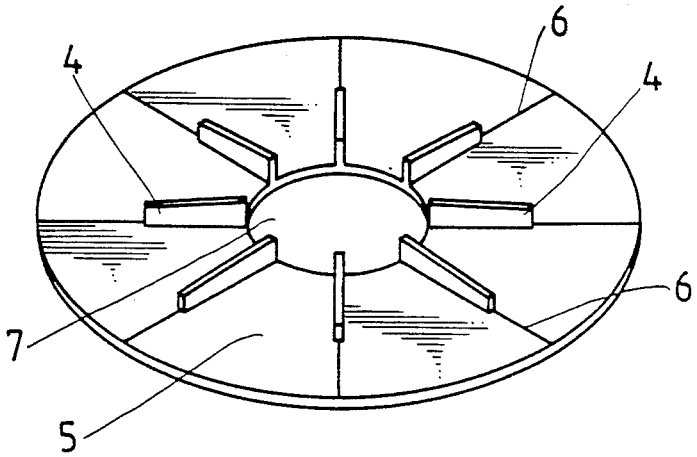
FIG. 2 shows the disc with slits and ribs extending partway across the disc.
Figure 3:
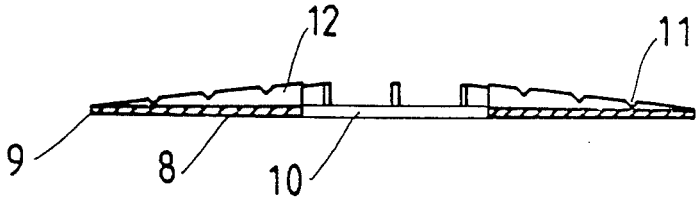
FIG. 3 shows a detail of further alternative construction of disc.

Modifications to the embodiment described above with reference to FIG. 1 are illustrated in FIGS. 2 and 3.

In FIG. 2 the disc is made for use where a greater flexibility of the disc is required. This is often necessary where the swimming pool cleaner has in the course of its cleaning movement, to negotiate corners between floor and wall of the swimming pool which corners are of small radius.

In FIG. 2 the greater flexibility is obtained by having ribs 4 extend only partway across the upper surface of the disc 5. The flexibility of the disc is still further increased by the provision of slits 6 which extend inwardly from the periphery of the disc 5 to the outer ends of the ribs 4. As shown, the ribs 4 decrease in height from the central opening 7.

The location and lengths of the slits need not be confined to the positions illustrated in FIG. 2. They may for example extend partway along the length of and closely adjacent to the ribs illustrated in FIG. 1.

FIG. 3 shows two further means for obtaining flexibility of the disc 8 decreasing in thickness from the central opening to the periphery 9. As shown, the thickness at the opening 10 is greater than at the periphery 9. Also notches 11 in the ribs 12 increase flexibility while not, in practice, being found to materially affect the guiding of dirt into the pool cleaner.

It will thus be appreciated that the disc and ribs can be varied in many ways while still functioning in the desired manner.

What is claimed:

1. A plastics material flexible disc shaped to engage around the inlet of a swimming pool cleaner which in use is caused to move by an interruption of flow induced through the cleaner in which the disc has guides on the upper surface thereof which extend radially from a central opening through the disc outwardly at least halfway to the periphery of the disc.

2. A flexible disc as claimed in claim 1 in which the guides are a pair of spaced apart ribs increasing in height inwardly towards the center.

3. A flexible disc as claimed in claim 2 in which there are eight ribs equally spaced apart.

4. A flexible disc as claimed in claim 3 in which the guides extend to the periphery of the disc.

5. A flexible disc as claimed in claim 3 in which the ribs are notched at at least one position intermediate their ends.

6. A flexible disc as claimed in claim 1 in which the disc has a plurality of slits extending radially inwardly from the periphery of the disc partway towards the center.

7. A flexible disc as claimed in claim 6 in which the slits extend inwardly from the periphery of the disc to the ends of the ribs with the ribs extending only partway across the disc.

8. A flexible disc as claimed in claim 1 in which the thickness of the disc increases from the periphery toward the center.

* * * * *